United States Patent [19]

Sims

[11] Patent Number: 4,494,725

[45] Date of Patent: Jan. 22, 1985

[54] CONCRETE FORM HOLDERS

[76] Inventor: George J. Sims, 5933 20th St., Rio Linda, Calif. 95673

[21] Appl. No.: 462,210

[22] Filed: Jan. 31, 1983

[51] Int. Cl.[3] ..... E04G 17/02

[52] U.S. Cl. ..... 249/219 R; 249/2; 249/5; 249/208; 249/216

[58] Field of Search ..... 249/2, 5, 4, 208, 216, 249/217, 219 R

[56] References Cited

U.S. PATENT DOCUMENTS

| | | | |
|---|---|---|---|
| 877,870 | 1/1908 | Shone et al. | 249/8 |
| 1,067,420 | 7/1913 | Forbis | 249/5 |
| 2,140,669 | 12/1938 | de Vigier | 249/210 |
| 2,298,837 | 10/1942 | Oswald | 249/5 |
| 3,288,426 | 11/1966 | Simpson | 249/5 |

FOREIGN PATENT DOCUMENTS

| | | | |
|---|---|---|---|
| 720827 | of 1927 | Australia | 249/2 |

*Primary Examiner*—Jan Silbaugh

*Attorney, Agent, or Firm*—Mark C. Jacobs

[57] ABSTRACT

A clip or retainer for supporting wood members for the creation of forms for concrete pours, primarily for curbs and gutters comprised of a pair of spaced, both of which are usually horizontal, members joined at their ends to front and rear bars, the rear of which is vertical while the front one is vertical at its upper portion, and depending outward from a point of junction with the lower horizontal bar to a point of termination, or the front one can be vertical in its entirety depending upon its intended use.

11 Claims, 9 Drawing Figures

CONCRETE FORM HOLDERS

BACKGROUND OF THE INVENTION

Just as the cost of housing construction has gone sky high recently so too has the cost of construction of concrete building foundations, and the cost of concrete curbs and gutters, which must be provided by the home builder. There is a need therefore to help contain costs by reducing the amount of labor hours for the construction of both building foundations and the construction of curbs and gutters.

It is an object therefor to provide a novel concrete retainer clip utilizeable with standard wood boards to produce a concrete pour form.

It is another object to provide a retainer bracket used to prepare concrete pour forms for foundations for buildings and for curbs and gutters.

It is yet another object to provide a retainer bracket for use of which significantly reduces the manhours needed to form large concrete pourings.

Other objects of the invention will in part be obvious and will in part appear hereinafter.

The invention accordingly comprises the product possessing the features, properties and relation of components which are exemplified in the following detailed disclosure, and the scope of the application of which will be indicated in the appended claims.

For a fuller understanding of the nature and objects of the invention, reference would be had to the following detailed description taken in conjunction with the accompanying drawings.

SUMMARY OF THE INVENTION

The concrete form retainer of this invention includes a pair of spaced members, both of which are usually horizontal, joined at their ends to each of a front and rear bar. The top member is horizontal and is joined at the distal end of each of front and rear bars while the bottom of the spaced members is joined to the front and rear bars spaced down from the top horizontal bar.

In one embodiment the front bar is of equal elevation to the rear bar, while in another embodiment the front bar is shorter than the rear bar and depends forwardly from the point of junction of the bottom horizontal member.

DESCRIPTION OF THE PREFERRED EMBODIMENT

Figure 1:
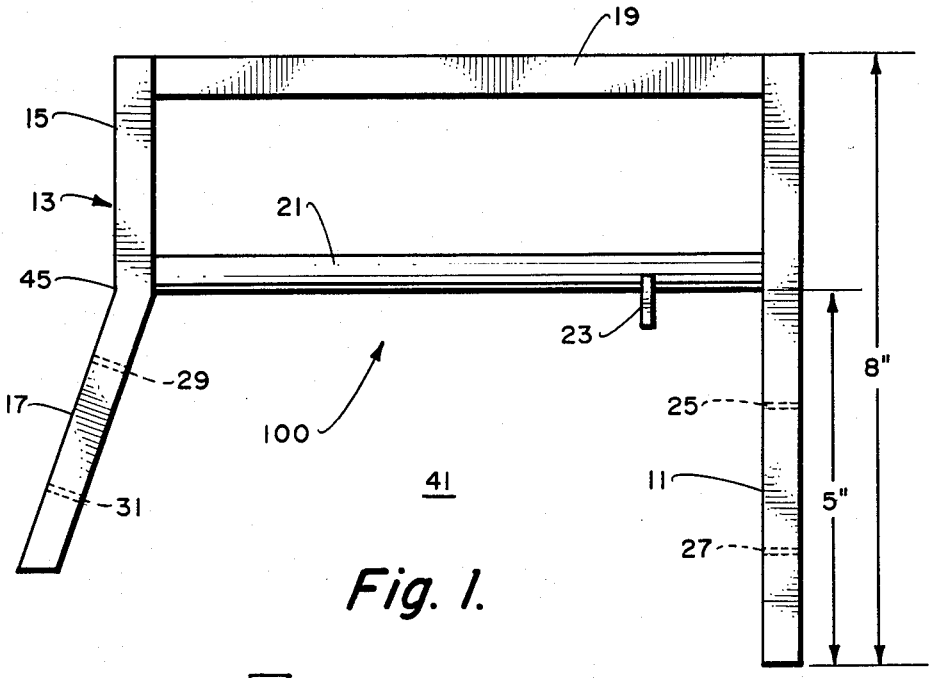
FIG. 1 is a left side elevational view of the first embodiment of this invention, the right sideview being a mirror image.

Turning now to the drawings, where in FIG. 1 there is shown the first embodiment 100 of the instant invention. This version of the device is used in the casting of curbs and gutters and includes an inclined second portion of the front bar for the reasons to be explained.

Retainer clip 100 includes a pair of spaced horizontal members 19 and 21, the top and bottom designations respectively, joined at their opposite ends to a pair of bars 11 and 13. Rear bar 11 is joined at one end in a right angle to top member 19, and to horizontal member 21 at the end thereof, along the length of said bar. Generally the distance between the outside edges of horizontal members 19 and 21 will be between 2" and 4", and preferably about 3 inches.

Front bar 13 consists of a first portion 15 which depends vertically from a junction with horizontal member 19 to a point of termination at an intersection with horizontal member 21. A second portion 17 depends angularly forward from a junction with first portion 15 and the forward end of horizontal member 21. For ease of manufacturing said first and second portions 15,17 can be constructed integrally. The elevation of second portion 17, as opposed to its length, is dependent upon the height of the concrete pour to be made as will be discussed infra with respect to FIG. 4. Generally a differential of 2" to about 3" is suggested. The angle at which the second portion depends forwardly will in part vary with the local building code as to what angle is required for the rise between the concrete gutter and the sidewalk. An angle of incline found suitable in California is about 20°.

Device 100 further includes a small boss 23 which depends downwardly from the underside of preferably horizontal member 21. The spacing from rear bar 11 of boss 23 is set to correspond to the thickness of a 2×? piece of lumber which as will be explained is used with the device of this invention. Since a 2 by (2×) is considered the standard of the construction trades, the spacing is set at 1.5 inches, the thickness of 2× lumber. Boss 23 depends down about ½ inch or so but the exact distance is not critical. It need only be sufficient to hold a board therein for nailing. Obviously, other spacings for thicker lumber can also be employed which would effect the positioning of boss 23.

A plurality of bores are disposed at convenient locations along the length of the rear bar below the bottom horizontal member. These preferably horizontal, for ease of use, nail bores 25 and 27 penetrate from behind the rear bar 11 toward space 41, the space between the front and rear bars. A second plurality of nail bores, two are shown in the figure, 29 and 31 penetrate the second portion of the front bar 17 preferably downwardly and inwardly toward space 41. These bores should be normal to the disposition of bar portion 17 for ease of use.

As has already been hinted at, wood boards 35 and 37 are secured to device 10 by nailing through the two pluralities of nail bores.

Figure 7:
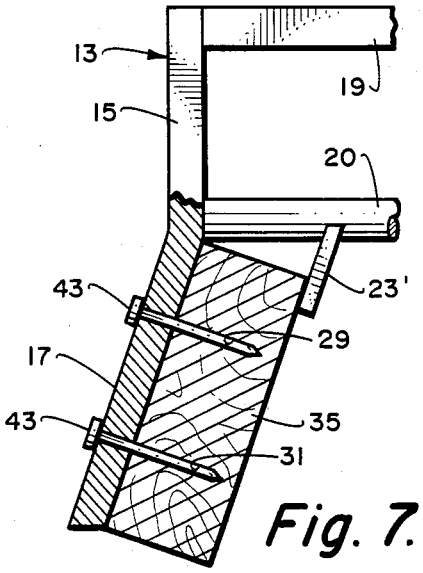
FIG. 7 is a closeup fragmented view of a variant of the device of FIG. 1.

In FIG. 7 a variant of the device of FIG. 1 is shown which includes an optional second angularly disposed boss 23'. This would be employed in the same manner as boss 23 to retain a board, here face board 35, such that it can be secured by nails 43 to the inclined bar portion 17, said nails being shown partially inserted.

Figure 2:
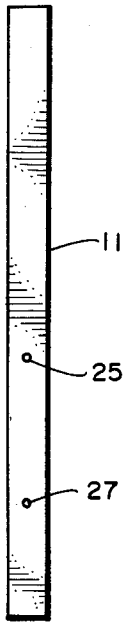
FIG. 2 is a rear elevational view thereof.

FIG. 2 is seen to be a rear elevational view of rear bar 11, showing the plurality of nail bores, here two designated 25 and 27.

Figure 3:
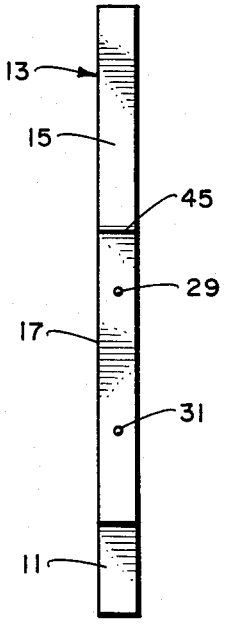
FIG. 3 is a front elevational view thereof.

FIG. 3 is a front elevational view of the device showing the two portions 15 and 17 of the front bar and that part of the rear bar 11 which extends below the portion 17.

While the junction of portion 17 to portion 15 is shown as a hard angle, at junction point 45, it is within the scope of the invention, especially if bar 13 is 1 piece to employ a curved junction to achieve the same angular relationship between portions 15 and 17.

The front and rear bars are preferably made from ½ inch square tubing or square bar stock such as of steel or aluminum. The flat surface gives maximum surface area upon which the wood board can lay for both rigidity and ease of nailing.

The top horizontal member may be made of the same material as the front and rear bars or of the same material as the lower horizontal member. The lower horizontal member could be made of square material but such is not considered desirable. Preferably round stock, such as rebar is utilized as this gives rise to a minimal surface area in contact with the cement pour. Such minimal contact facilitates troweling to remove the contact line. Since the bosses employed are generally no longer than ½ inch or so, it is a simple job to smooth out the slight depression in the concrete that will occur upon removal of the form.

Figure 5:
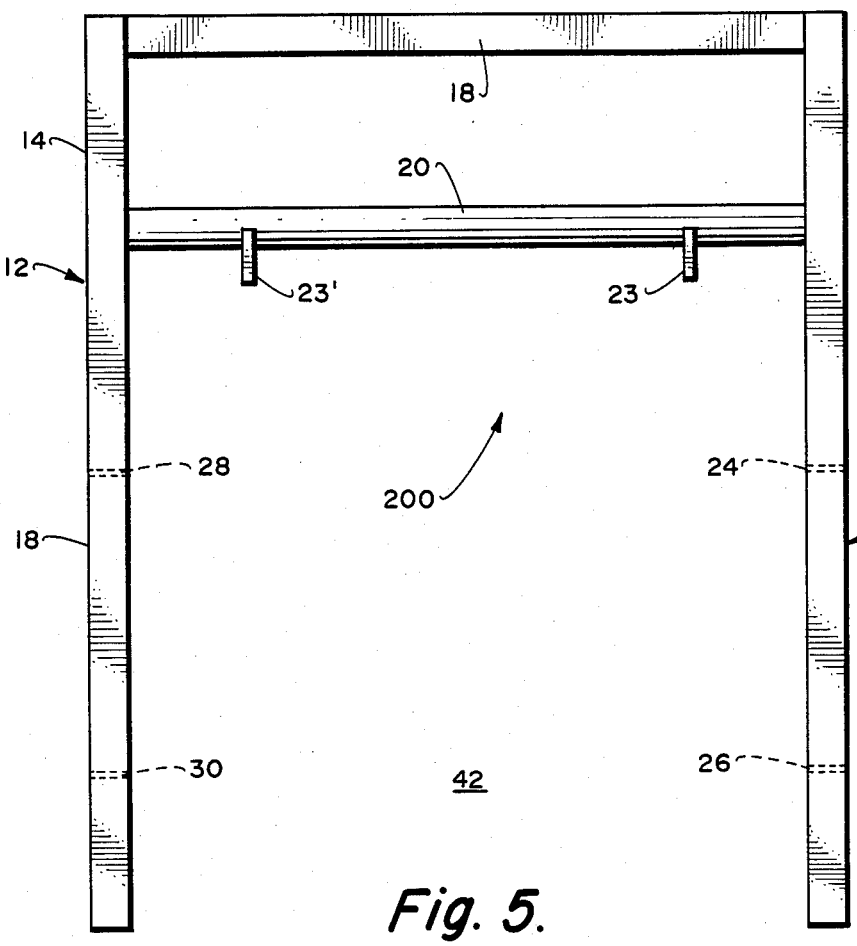
FIG. 5 is an elevational view of the left side of the second embodiment of this invention. The right side view being a mirror image thereof.

Turning now to FIG. 5, there is shown a second embodiment of this invention. Whereas curbs and gutters are made from the concrete pours used with the first embodiment, this version is intended for use in the pouring of foundations for houses and other small buildings. Such concrete pourings would be used instead of cinder block foundations.

Device 200 is configured similar to device 100 but for the front leg 12. Here the upper or first portion 14 is vertical and the lower or second portion is also vertical. In addition, both the front and rear bars 10 and 12 are of the same length, e.g. 8". Rear bar 10 is similar to rear bar 11, of FIG. 1. Horizontal members 18 and 20 are the same as horizontal members 19 and 21, and are joined in like manner, as by welding, brazing or soldering to the rear and front bars. Designator 42 is for the space between the upright bars, 10 and 12. Note the use of two bosses 23.

Figure 6:
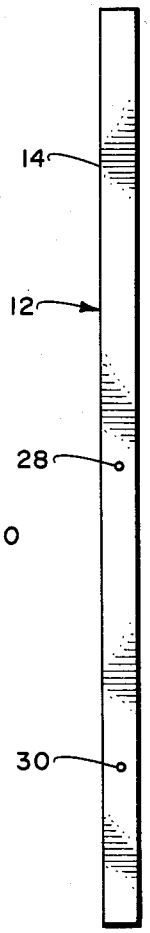
FIG. 6 is a front elevational view of the second embodiment of this invention.

FIG. 6 is a front elevational view of the embodiment of FIG. 5. A view of bar 10 would have the same appearance, but of course the nail bores would bear different numbers, namely 24 and 26 rather than 28 and 30.

Though not previously mentioned, it is within the scope of the invention to form devices 100 and 200 as one piece metal or even plastic coatings.

While the spacing of the two horizontal members can be the same or different for device 200 as compared to device 100, it is believed that since similar materials are employed nearly ½ inch square and ½ inch round stock for the components previously discussed, that similar spacing of about 3 inches will achieve good results, i.e. pours with upright front and rear surfaces.

The total elevation however of the front and rear bars is of course dependent upon the size or depth of pour of the foundation. Many building codes provide for a 12 to 15 inch foundation. Thus the height of the bars below the lower spaced member would be about 12–15". The span between the front and rear bars, for both embodiments will generally be about 8 to 10 inches.

UTILIZATION

Figure 4:
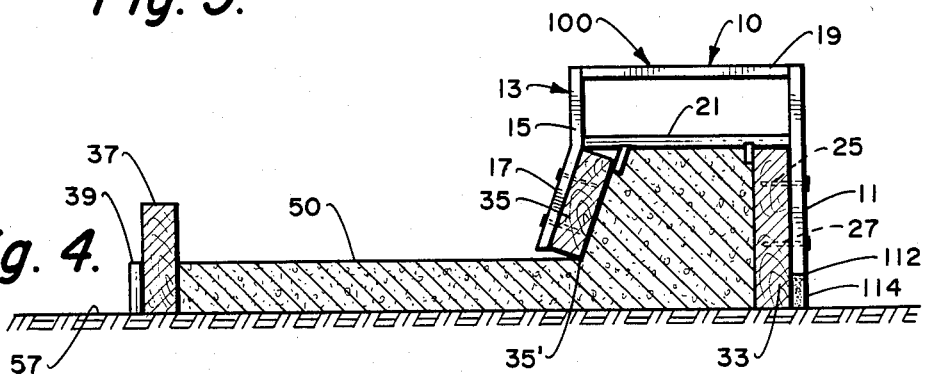
FIG. 4 is a pictorial elevation drawing showing the use of the device of this invention.

Reference is now made to FIG. 4 for the utilization of the embodiment of FIG. 1. A plurality of device 100 are set out at desired intervals, usually about 3 to 4 feet apart along the ground where the concrete pour is to be made. Rear board 33 is secured to bar 11 by placing nails, not seen, through bores 25 and 27 into the board for each device 100 employed. As a result of this activity, the devices 100 will now stand upright in the smoothed earth surface 57. Leg 11 can terminate at point 112, or be sized to touch the ground, as by including the shaded portion 114 therein.

In forming the combination of curb and gutter as shown in FIG. 4, street board 37, so designated because it is in the street, is secured to a series of spaced conventional posts 39 which are sunk into the earth. This step is conventional and forms no part of this invention. The distance between rear board 33 and street board 37 is the span for the concrete pour 50.

Angle board 35 is secured to the angled portion 17 of the front bar for each of the devices 10. The size of the face board may serve as a guide means for the depth of pour of the gutter portion of the curb-gutter, since the pour should extend upwardly from the earth 57 beyond the angled corner 35' of said board 35.

The angled face board 35 serves as a forming surface for the river between the curb and gutter, and therefore a uniform inclined plane will always be achieved. The elevation of the curb portion of the curb-gutter is defined by the elevation of the bottom horizontal member 21.

When the concrete or cement pour has set, the retainer clips with the boards still attached can be removed by the workmen. It is a simple job then to trowel out any groves or unsmooth areas that may exist.

Figure 8:
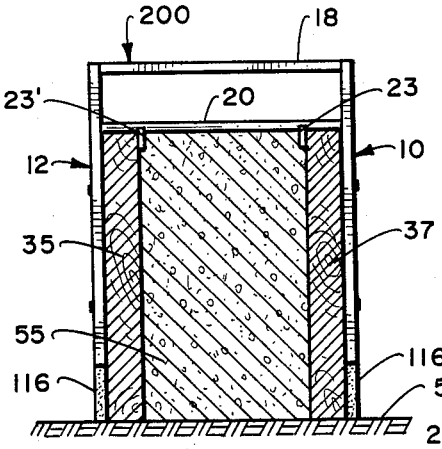
FIG. 8 is a pictorial elevation drawing showing the use of the second embodiment of this invention for the production of a building foundation.
Figure 9:
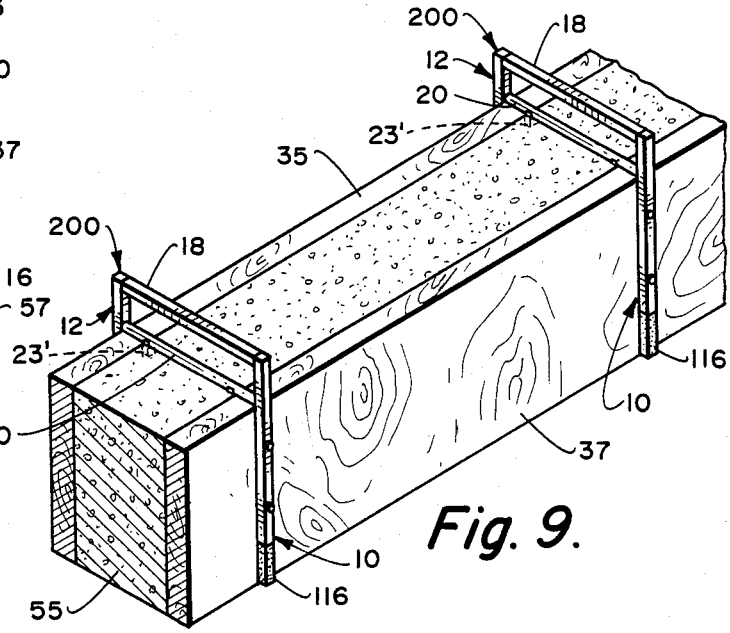
FIG. 9 is a perspective view showing the use of the second embodiment of the device of this invention.

Turning now to FIGS. 8 and 9 we see an end view and a perspective view respectively that illustrate the use of the device 200. Here again, a front board 35 and rear board 37 are nailed into place and then set out on the ground 57. Note that for illustration purposes in FIG. 8, the bosses 23 and 23' are shown but they are not both depicted in FIG. 9 as the concrete pour 55 and the wall board 37 hides one of them in the angle shown.

In FIGS. 8 and 9, legs 10 and 12 are shown their standard length, which is less than the height of the form boards, and also with the optional added length 116 which would permit the bars to reach ground level. For special processes it may be desirable in device 200 to have one of said bars shorter than the other. While it has previously been mentioned that the top horizontal member could be square stock, round stock is preferred, as it is both easier to carry as round stock fits better in one's grasp; and small burrs and jagged edges are more easily avoided by using round stock for the top members.

It is believed that up to about thirty percent (30%) of the labor time involved with setting up for a concrete pour for combined curb and gutter, and for building foundations can be saved by using the devices of this invention.

The instant devices are readily portable and are both easy to manufacture and easy to use.

While shown horizontal, it is also within the scope of the invention for the lower horizontal member to be angled for special position if desired, for both embodiments, if an inclined pour is desired. The top spaced member should be horizontal to ease eye-balling the locations for obtaining parallel pours and ease of handling. The bottom member may be angled or generally horizontal, though most use would be for a horizontal member.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A retainer clip used in the preparation of a form for pouring concrete and which comprises:

a pair of vertically spaced generally horizontal members, the lower of which is round in cross section, to minimize concrete pour contact secured on their ends to each of a front and rear bar, the upper of said horizontal members being joined to one end of said front and rear bars, the lower of said horizontal member being joined along the elevation of the front and rear bars at its termini, at least the rear of said bars being disposed normal to said top member, said bottom member also including at least one downwardly depending boss spaced from one of said bars along the underside of said bottom member a distance sufficient to hold a form board between the boss and said one of said bars, each of said front and rear bars having inwardly directed through bores along their extension below said bottom members to provide for attachment of form boards to said bars.

2. The retainer clip of claim 1 wherein the front bar is entirely vertical.

3. The retainer clip of claim 1 wherein the front bar is vertical to the top and bottom horizontal members and depends outwardly from its point of junction with the lower horizontal member.

4. The retainer clip of claim 3 wherein the front bar includes a first portion normal to said horizontal bars, and a second portion angularly disposed thereto and said front bar is of lesser elevation than said rear bar.

5. The retainer clip of claim 1 wherein the front and rear bars are of a square configuration in cross section.

6. The retainer clip of claim 1 wherein the generally horizontal members are of equal extension.

7. The retainer clip of claim 1 wherein the front and rear bars are parallel and of equal extension.

8. The retainer clip of claim 7 wherein two bosses depend downwardly from said lower member, each spaced in from its respective teminus.

9. The retainer clip of claim 1 wherein the front and rear bars are made of square steel bar stock, and the horizontal members are round rebar steel.

10. The retainer clip of claim 1 wherein two throughbores are disposed spaced one above the other, and spaced down from said bottom member.

11. The retainer clip of claim 10 wherein the throughbores are normal to said front and rear bars disposition.

* * * * *